US006095866A

United States Patent [19]

Helbig et al.

[11] Patent Number: 6,095,866

[45] Date of Patent: Aug. 1, 2000

[54] ELECTRIC LAMP

[75] Inventors: Peter Helbig, Sontheim; Hermann Steiner, Herbrechtingen; Hans Wild, Gerstetten, all of Germany

[73] Assignee: Patent-Treuhand-Gesellschaft fuer elektrische Gluehlampen mbH, Munich, Germany

[21] Appl. No.: 09/125,392

[22] PCT Filed: Dec. 10, 1997

[86] PCT No.: PCT/DE97/02876

§ 371 Date: Aug. 18, 1998

§ 102(e) Date: Aug. 18, 1998

[87] PCT Pub. No.: WO98/27567

PCT Pub. Date: Jun. 25, 1998

[30] Foreign Application Priority Data

Dec. 18, 1996 [DE] Germany ..... 296 22 029 U

[51] Int. Cl.[7] ..... H01K 1/00

[52] U.S. Cl. ..... 439/619

[58] Field of Search ..... 439/356, 366, 439/619

[56] References Cited

U.S. PATENT DOCUMENTS

| | | | |
|---|---|---|---|
| 5,120,233 | 6/1992 | Mikola | 439/356 |
| 5,320,562 | 6/1994 | Moller et al. . | |
| 5,752,842 | 5/1998 | Friederichs et al. | 439/152 |

FOREIGN PATENT DOCUMENTS

| | | |
|---|---|---|
| 0478058 | 4/1992 | European Pat. Off. . |
| 9635220 | 11/1996 | WIPO . |
| 9625733 | 7/1997 | WIPO . |

*Primary Examiner*—Khiem Nguyen
*Attorney, Agent, or Firm*—William E. Meyer

[57] ABSTRACT

The invention relates to an electric lamp, more particularly to a lamp for a motor vehicle, the cap of which is provided with a metal support sleeve (53) constructed in the shape of a ring and at least one pressure spring (1) for securing the lamp in the lampholder. The at least one pressure spring (1) is constructed as a cambered leaf spring whose ends (11, 12) bear against the inner wall of the support sleeve and which has a V-shaped region (100) which reaches through a cutout (53*b*) in the support sleeve (53).

4 Claims, 4 Drawing Sheets

ELECTRIC LAMP

TECHNICAL FIELD

The invention relates to electric lamps and particularly to electric lamp mountings. More particularly the invention is concerned with a lamp mounting with a spring.

BACKGROUND ART

Such an electric lamp is described, for example, in Patent Application PCT/DE96/01982. This patent application describes a cementlessly capped electric lamp for use in a motor vehicle headlight. This lamp has a lamp cap constructed from metal parts and plastic parts. The lamp cap has a metal holding part in which the lamp bulb is fixed, a metal support sleeve supporting the holding part, and a plastic cap part, which is provided with the electric terminals of the lamp and in which the support sleeve is anchored. The metal support sleeve of the lamp is constructed in the shape of a ring and matched to the fitting diameter of the opening, constructed as a lampholder, of the headlight reflector, and equipped with at least one pressure spring which, after the lamp has been installed in the reflector, bears against the reflector wall in the region of the lamp holder. This at least one pressure spring ensures the lamp is firmly seated in the lampholder of the reflector, and balances slight tolerances in the manufacture of the lamp cap and in the opening, constructed as lampholder, of the headlight reflector. The at least one pressure spring is designed as a cambered leaf spring whose ends bear against the inner wall of the metal, ring-shaped support sleeve. Moreover, the at least one leaf spring has an outwardly cambered section which reaches through a cutout in the support sleeve and, after the lamp has been installed in the reflector, bears against the reflector wall in the region of the lampholder, as well as two inwardly cambered sections, which are arranged on both sides of the outwardly cambered section of the leaf spring.

DISCLOSURE OF THE INVENTION

In the electric lamp according to the invention, the lamp cap is fitted with at least one pressure spring which, after the lamp has been installed in the headlight reflector, bears against the reflector wall in the region of the lampholder and ensures that the lamp is seated firmly in the lampholder of the reflector. The pressure spring is constructed as a cambered leaf spring. It has an outwardly cambered section, which reaches through a cutout in the support sleeve and, after the lamp has been installed in the headlight reflector, bears against the reflector wall, and which is provided according to the invention with a V-shaped region. At least the connecting piece connecting the two V limbs reaches through the cutout in the support sleeve, with the result that, after the lamp has been installed in the headlight reflector, it bears resiliently against the reflector wall constructed as the lampholder. The spring action of the pressure spring is improved by comparison with the prior art quoted above by means of the V-shaped region. The V-shaped region of the outwardly cambered section reduces the contact area between the lampholder and the pressure spring by comparison with the prior art, and increases the contact pressure. In this case, the angle which the two V limbs of the V-shaped region form with one another is advantageously selected such that it is between 80 degrees and 110 degrees. In order to avoid scratch traces on the lampholder when assembling the lamp in the headlight, the connecting piece connecting the two V limbs is advantageously rounded. The two inwardly cambered sections of the leaf spring are advantageously constructed in the shape of a U. As a result, by comparison with the prior art the pressure acting on the leaf spring after the lamp has been mounted can be better absorbed by a reversible deformation of the inwardly cambered sections, that is to say by a reversible compression of the U-shaped sections of the leaf spring.

BRIEF DESCRIPTION OF THE DRAWINGS

The invention is explained in more detail below with the aid of a preferred exemplary embodiment. In the drawing.

BEST MODE FOR CARRYING OUT THE INVENTION

Figure 1:
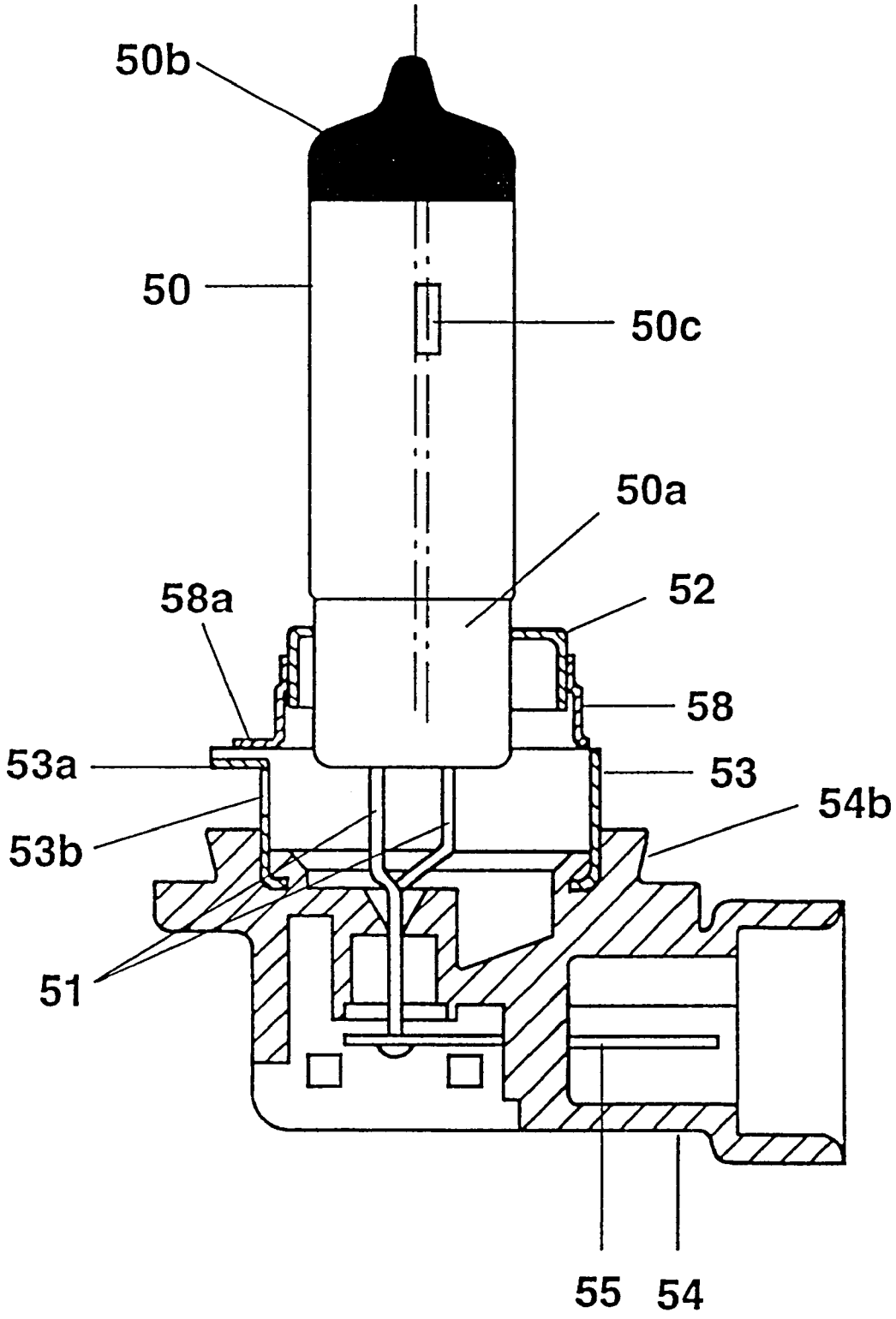
FIG. 1 shows a diagrammatic side view of an electric lamp according to the invention.

In the preferred exemplary embodiment of the electric lamp according to the invention, it is a single-filament halogen lamp which is provided for use in a motor vehicle headlight. This lamp has an essentially cylindrical glass lamp bulb 50 with a tightly pinched end 50*a* which is termed the pinched foot 50*a*. The dome 50*b* of the lamp bulb 50 is provided with a black, light-absorbing coating. The light source is an incandescent filament 50*c*, which is aligned parallel to the lamp bulb axis and is connected in an electrically conducting fashion to lead-in wires 51 brought out of the pinched foot 50*a*. The lamp bulb 50 is fixed with its pinched foot 50*a* in a metal holding part 52 constructed as a fixing ring. The fixing ring 52 is supported by a metal intermediate ring 58, which is equipped with three integrally formed, angled-away welding lugs 58*a*. For its part, the intermediate ring 58 is welded to a metal support sleeve 53 by LASER. In addition to the metal fixing ring 52, the intermediate ring 58 and the metal support sleeve 53, the lamp cap also has a plastic cap part 54, which is provided with the electric terminals 55 of the lamp and in which the support sleeve 53 is anchored. The electric terminals 55 of the lamp are respectively welded to one of the lead-in wires 51. The plastic cap part 54 is an injection-moulded part into which the metal support sleeve 53 is injected.

The support sleeve 53 has three integrally formed reference noses 53*a*, which are arranged equidistantly along a circular circumference and are used to adjust the incandescent filament 50*c* and to fasten the lamp in the reflector (not illustrated) of the headlight. The reference noses 53*a* are angled away from the support sleeve 53 and lie in a common plane. The welding lugs 58*a* of the intermediate ring 58 are welded to these reference noses 53*a* by LASER. The intermediate ring 58 offers additional possibilities of adjustment in the reference plane defined by the reference noses 53*a*.

The plastic cap part 54 has a circumferential, conically designed groove 54*b* which is in the shape of a ring and in which a sealing ring (not illustrated) made from rubber or silicon is arranged. The sealing ring bears against the outside of the reflector wall and seals the opening, constructed as lampholder, of the reflector. The inside diameter of the sealing ring is matched true to size to the conically designed groove 54*b*, and varies linearly with the height of the sealing ring. A cambered leaf spring 1 (FIG. 3), which serves to fasten the lamp in the headlight, projects through a cutout 53*b*, arranged below one of the three reference noses 53*a*, in the wall of the support sleeve 53 in the shape of a ring. The ends 11, 12 of the leaf spring 1 bear against the inner wall of the support sleeve 53 and against in each case one stop 59*a*, 59*b* constructed in one piece with the plastic cap part 54, with the result that the leaf spring 1 is fixed clamped between these two stops 59*a*, 59*b* designed as a holder.

Figure 3:
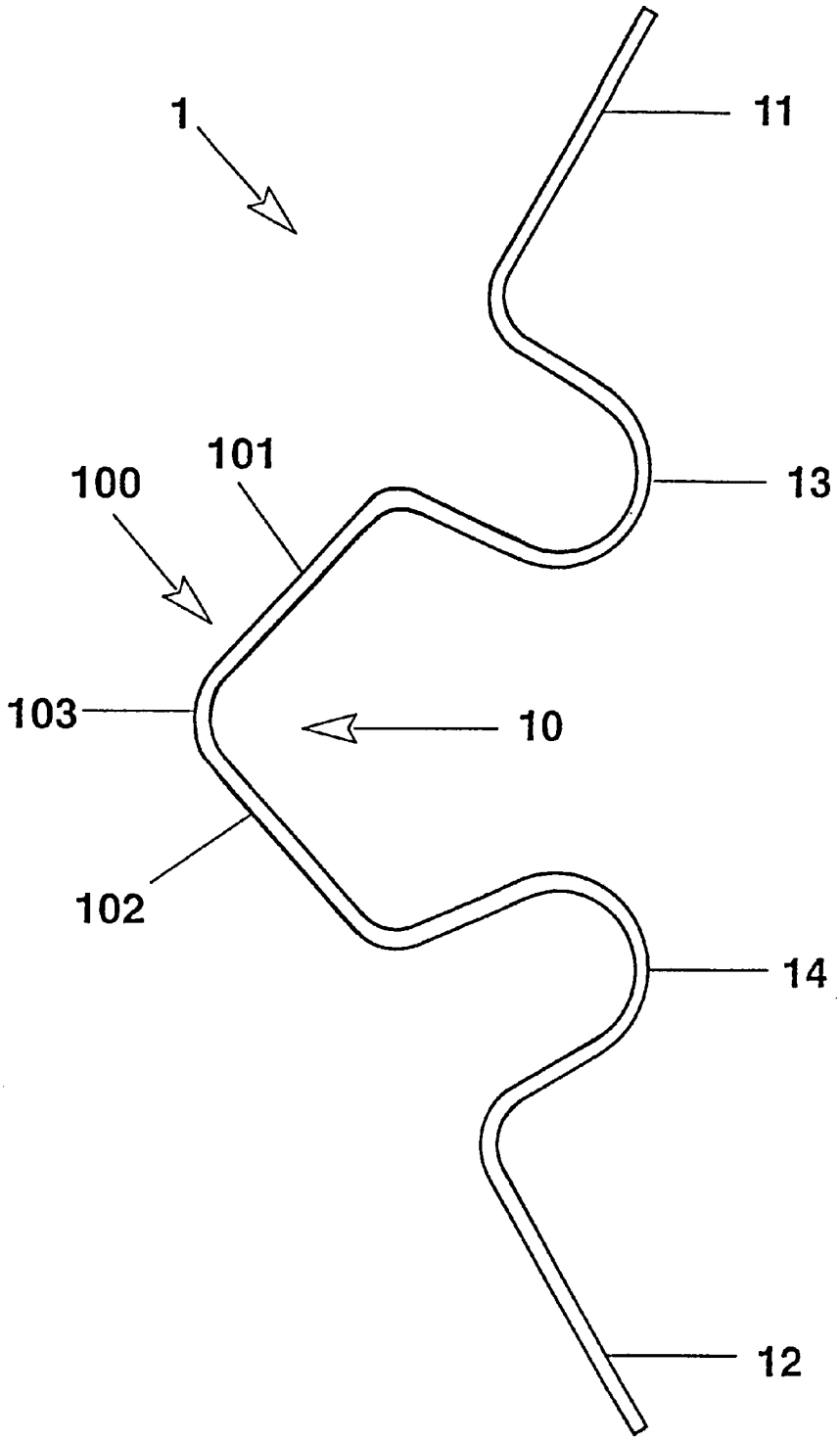
FIG. 3 shows a side view of the pressure spring according to the invention.

The three reference noses 53*a*, the sealing ring arranged in the groove 54*b*, and the pressure spring 1 serve to fasten the lamp in the lampholder of the headlight reflector. The lamp cap and the lampholder form a bayonet catch. In order to install the lamp in the reflector, the lamp is inserted, with the lamp bulb 50 in front, into the opening, constructed as lampholder, of the reflector, the three reference noses 53*a* respectively reaching through a true-to-size recess in the edge of the opening. Thereafter, the lamp is turned in the lampholder as far as a stop, with the result that the reflector wall is arranged seated clamped between the reference noses 53*a* and the sealing ring. The pressure spring 1 bears resiliently against the edge of the opening, constructed as lampholder, of the reflector. In order to prevent the lamp from being erroneously installed in the reflector, all three reference noses 53*a* are of different shape. The same also holds, of course, for the recesses, matched to the reference noses 53*a*, in the opening constructed as lampholder. Details of the pressure spring 1 are represented in FIG. 3.

Figure 2:
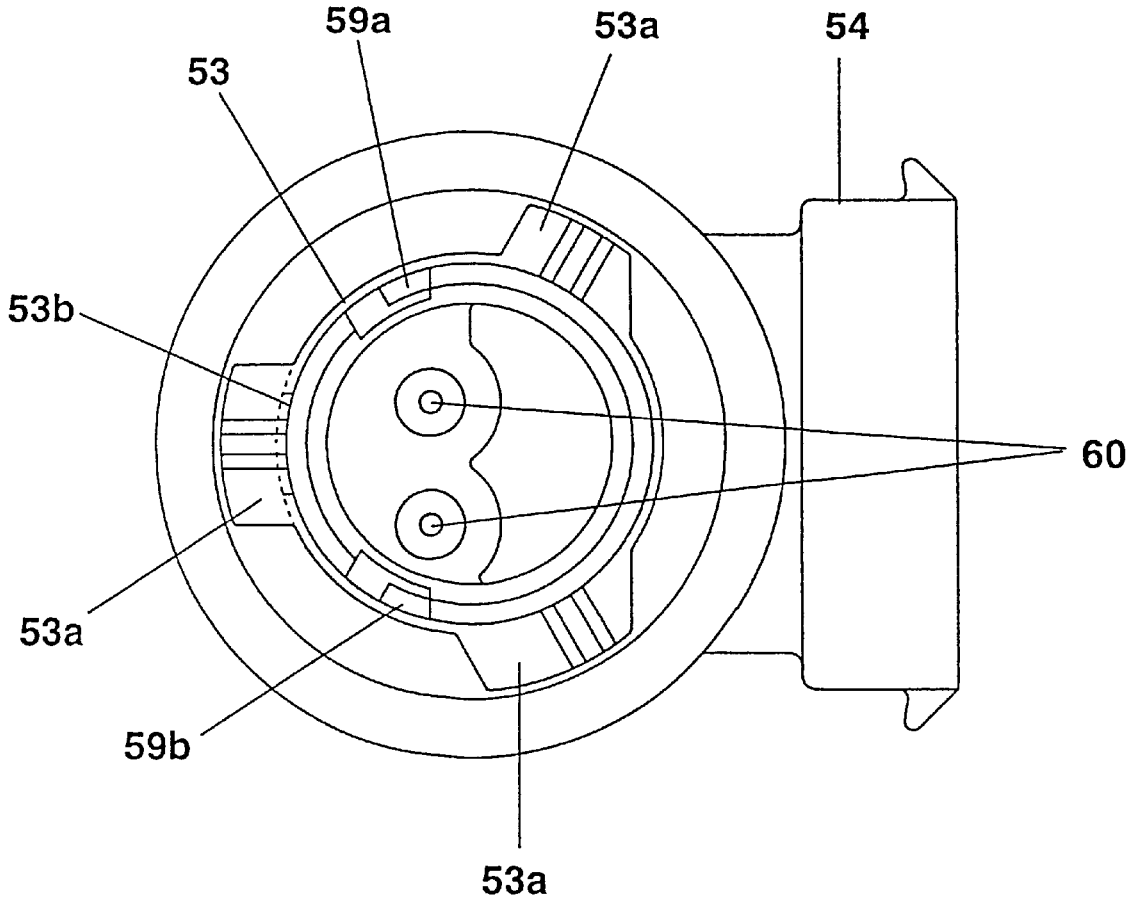
FIG. 2 shows a top view of the plastic cap part and the metal support sleeve, injected therein, of the electric lamp illustrated in FIG. 1.

The pressure spring 1 is constructed as a cambered leaf spring. It has two slightly curved ends 11, 12 which, after they are mounted, bear against the inner wall of the support sleeve 53 in the shape of a ring. Moreover, two stops 59*a*, 59*b* which are designed in one piece with the plastic cap part 54 and against which the ends 11, 12 abut are used to fix the leaf spring 1. The leaf spring 1 is thereby held clamped between these stops 59*a*, 59*b* (FIG. 10). It has an outwardly cambered section 10 with a V-shaped region 100 which, after the leaf spring 1 has been mounted, reaches through the cutout 53*b* in the support sleeve 53 and, after the lamp has been installed in the headlight bears in a clamped fashion against the reflector opening constructed as lampholder. The V limbs 101, 102 of the V-shaped region 100 form an angle of approximately 96 degrees with one another and are connected to one another by a rounded connecting piece 103. The cutout 53*b* is represented in the top view of FIG. 2 only with dashed lines, since it is covered by one of the reference noses 53*a*. The outwardly cambered section 10 of the leaf spring 1 is respectively connected by means of two inwardly cambered, U-shaped sections 13 or 14 to one of the leaf spring ends 11 or 12. The leaf spring 1 consists of a spring steel sheet of 0.25 mm thickness. The reference numeral 60 in FIG. 2 denotes the bushings for the lead-in wires 51 of the lamp in the plastic cap part 54.

Figure 4:
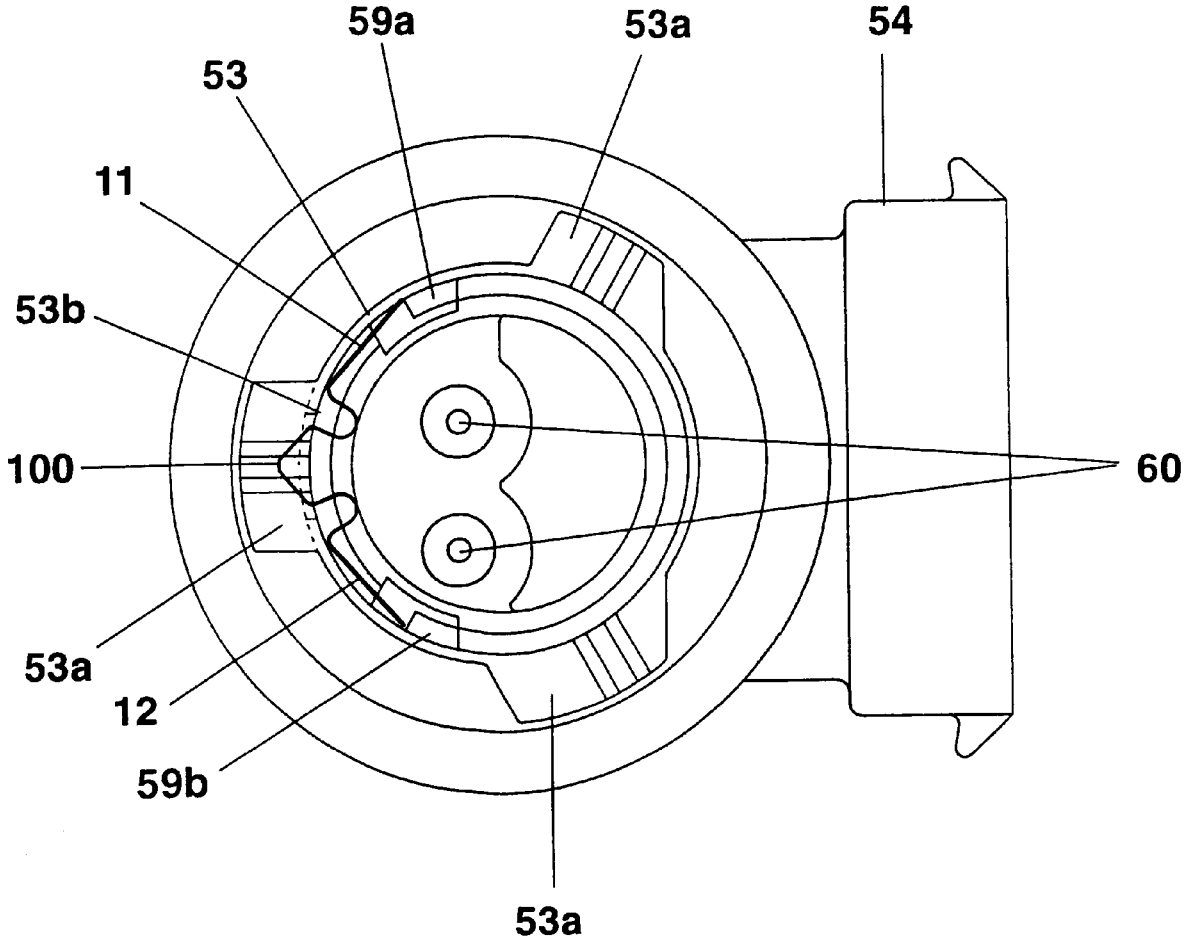
FIG. 4 shows a cross sectional view of the plastic cap part and the pressure spring

FIG. 4 shows a cross sectional view of the plastic cap part and the pressure spring. The electric lamp is seen to have a lamp cap which has a metal holding part (52) in which the bulb (50) of the lamp is fixed. The lamp cap has a metal support sleeve (53), connected to the metal holding part (52), and a plastic cap part (54), which is provided with electric terminals (55) of the lamp in which the metal support sleeve (53) is anchored. The metal support sleeve (53) is constructed in the shape of a ring and has a cutout (53b). The lamp cap is fitted with at least one pressure spring (1). The pressure spring (1) is constructed as a cambered leaf spring. The ends (11, 12) of the leaf spring (1) bear against the inner wall of the support sleeve (53). The leaf spring (1) has an outwardly cambered section (10) which reaches through the cutout (53b). The leaf spring (1) has two inwardly cambered sections (13, 14) which respectively connect the outwardly cambered section (10) to one of the leaf spring ends (11, 12). The outwardly cambered section (10) of the leaf spring (1) has a region (100) constructed in the shape of a V. At least the connecting piece (103) which connects the two limbs (101, 102) of the V-shaped region (10) reaches through the cutout (53*b*) in the support sleeve (53). it can bee seen that the two V-limbs (101, 102) of the V-shaped region (100) of the leaf spring (1) are connected to one another via a rounded connecting piece (103). It can be seen that the two V-limbs (101, 102) of the leaf spring (1) form with one another an angle of between 80 degrees and 110 degrees. It can be seen that the inwardly cambered sections (13, 14) of the leaf spring, (1) are constructed in the shape of a U.

What is claimed is:

1. An electric lamp comprising: a lamp cap which has a metal holding part (52) in which the bulb (50) of the lamp is fixed, the lamp cap having a metal support sleeve (53), connected to the metal holding part (52), and a plastic cap part (54), which is provided with electric terminals (55) of the lamp and in which the metal support sleeve (53) is anchored, the metal support sleeve (53) being constructed in the shape of a ring and having a cutout (53*b*), the lamp cap being fitted with at least one pressure spring (1) being constructed as a cambered leaf spring, the ends (11, 12) of the leaf spring (1) bearing against the inner wall of the support sleeve (53), the at least one leaf spring (1) having an outwardly cambered section (10) which reaches through the cutout (53*b*), and the at least one leaf spring (1) having two inwardly cambered sections (13, 14) which respectively connect the outwardly cambered section (10) to one of the leaf spring ends (11, 12), wherein the outwardly cambered section (10) of the at least one leaf spring (1) has a region (100) constructed in the shape of a V, at least the connecting piece (103) which connects the two V limbs (101, 102) of the V-shaped region (100) reaching through the cutout (53*b*) in the support sleeve (53).

2. An electric lamp according to claim 1, wherein the two V-limbs (101, 102) of the V-shaped region (100) of the leaf spring (1) are connected to one another via a rounded connecting piece (103).

3. An electric lamp according to claim 1, wherein the two V-limbs (101, 102) of the leaf spring (1) form with one another an angle of between 80 degrees and 110 degrees.

4. An electric lamp according to claim 1, wherein the inwardly cambered sections (13, 14) of the leaf spring (1) are constructed in the shape of a U.

* * * * *